United States Patent [19]

Pabsch

[11] Patent Number: 4,700,647

[45] Date of Patent: Oct. 20, 1987

[54] BOOM OF THE WISHBONE-TYPE FOR SAILING BOARDS

[75] Inventor: Arno R. E. K. Pabsch, Brunswick, Fed. Rep. of Germany

[73] Assignee: Deutsche Forschungs- und Versuchsanstalt fur Luft- und Raumfahrt e.V., Fed. Rep. of Germany

[21] Appl. No.: 841,792

[22] Filed: Mar. 14, 1986

[30] Foreign Application Priority Data

Mar. 22, 1985 [DE] Fed. Rep. of Germany ..... 3510294

[51] Int. Cl.[4] ..... B63H 9/10

[52] U.S. Cl. ..... 114/39; 114/89; 156/257

[58] Field of Search ..... 114/39.2, 97, 89, 90; 52/309.1, 309.4, 309.9, 727, 309.7, 309.13, 309.15, 309.16; 428/367, 71, 375, 377, 398; 156/257

[56] References Cited

U.S. PATENT DOCUMENTS

| | | | |
|---|---|---|---|
| 3,522,122 | 7/1970 | Ganahl | 156/171 |
| 3,567,541 | 3/1971 | Kaczerginski | 156/172 |
| 3,592,884 | 7/1971 | Williams | 264/45 |
| 3,972,529 | 8/1976 | McNeil | 156/257 |
| 4,070,021 | 1/1978 | Gecka et al. | 428/377 |
| 4,200,479 | 4/1980 | Ardell et al. | 156/257 |
| 4,312,162 | 1/1982 | Medney | 52/309.16 |
| 4,334,488 | 6/1982 | Joliuet | 114/39.2 |

FOREIGN PATENT DOCUMENTS 1316798 5/1973 United Kingdom .

*Primary Examiner*—Joseph F. Peters, Jr.
*Assistant Examiner*—Edwin L. Swinehart
*Attorney, Agent, or Firm*—Salter & Michaelson

[57] ABSTRACT

Boom of the wishbone-type for sailing boards, where the spars (4,6) at least have a core (12) made from a rigid foam, which has essentially plane surfaces on the inside and outside of the spars, which extend across a significant section of the length of the core. On the plane surfaces there are arranged synthetic-resin-strengthened UD-slivers (22), which extend in the longitudinal direction of the spars across the length thereof, and there is provided an outer layer (24) from a synthetic-resin-strengthened fibre fabric or braiding with slivers intersecting at an angle of between 30° and 60° to the longitudinal extension of the spars. The UD-slivers (22) are preferably arranged between the inner and the outer fabric layer (20,24) in the form of previously cured CFK-UD-strips.

13 Claims, 6 Drawing Figures

BOOM OF THE WISHBONE-TYPE FOR SAILING BOARDS

The invention relates to a boom of the wishbone-type for sailing boards.

It is known that the profile of the sail of a sailing board is, in the final analysis, dependent on the rigidity of the boom. Even minimal alterations in the length of the boom under the load of the sail and the holding power result in considerable changes in the profile of the sail and so in a deterioration in the forward thrust which can be achieved with the sail.

Where booms are concerned, the trend in recent years has therefore been towards ever more rigid booms. On the other hand, as low a weight as possible is required for booms.

In order to achieve a high level of rigidity with a low weight, highly-rigid booms are produced from high strength aluminum tubes. In this case, the boom spars which are shaped from the tubes are each connected via connectors with the end piece of the boom.

The rigidity in relation to its weight which can be achieved with the use of high strength aluminum tubes is limited by the material and weight.

In the case of a boom according to the generic species (DE-GM No. 82 00 406), there are provided one or more braided, knitted or woven tubes from synthetic-resin bonded carbon fibres, aramide or glass fibres on tubes preformed according to the radius of the spars of the boom. With booms designed in such a way, only a very minimal rigidity can be achieved.

Compound masts are also known (DE-OS No. 20 61 921), where there is designed on an inside mast from a foam material an outer casing from a synthetic-resin bonded fibrous fabric. The outer casing is here cured under radial compression of the inside mast to achieve a prestressing. Here it is further known to provide, between the inside mast from foam material and the outer casing, strengthening elements from carbon fibres, glass wool or the like, which can be bonded with synthetic-resin and which extend across the entire length of the mast.

The aim of the invention is to improve a boom for sailing boards in such a way that greater rigidity can be achieved with the same weight or less.

Suitable embodiments are the subject of the depending claims.

Booms according to the invention are not simply characterised by a greater rigidity than could be achieved previously. It is also possible for boom weights to be achieved, which are one third lower than those weights of the best booms known currently. It is possible for coefficients of rigidity—defined as test load divided by mass x multiplied by the shortening to be achieved, which are virtually twice as great as those in the case of the best booms known currently.

The invention is illustrated by way of example in the drawings and is subsequently described in detail with the aid of the drawings.

Figure 1:
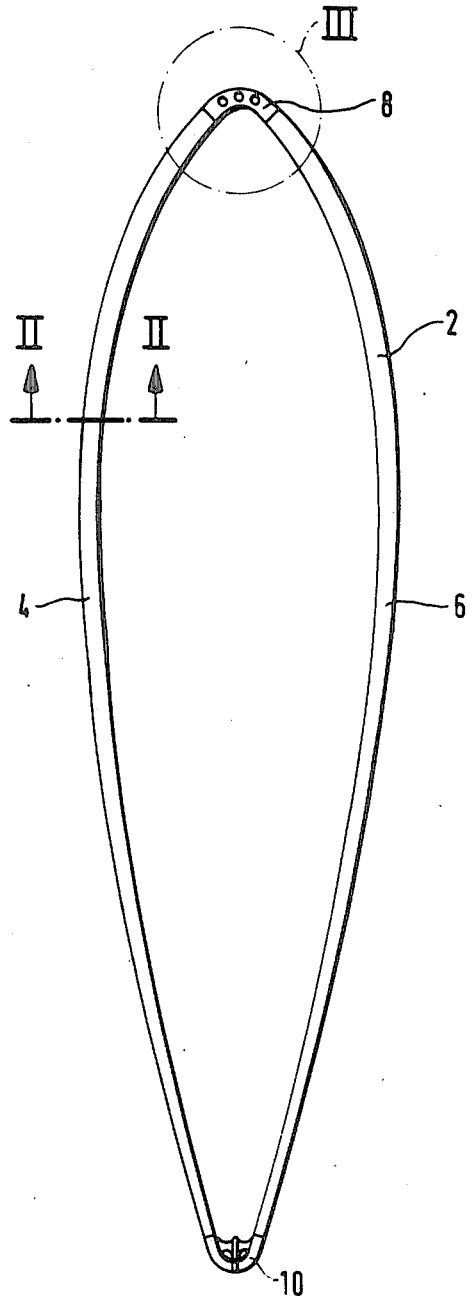
FIG. 1 shows a top view of a boom.

The boom 2 shown in top view in FIG. 1 has two spars 4, 6 and respective boom end pieces at the ends of the boom, which is to say the front boom end piece 8 and the rear boom end piece 10, with perpendicular rope guiding holes being provided in the usual way in the front boom end piece, while at the rear end pieces there is arranged a sail tension roller with horizontal or vertical axis of rotation.

Figure 2:
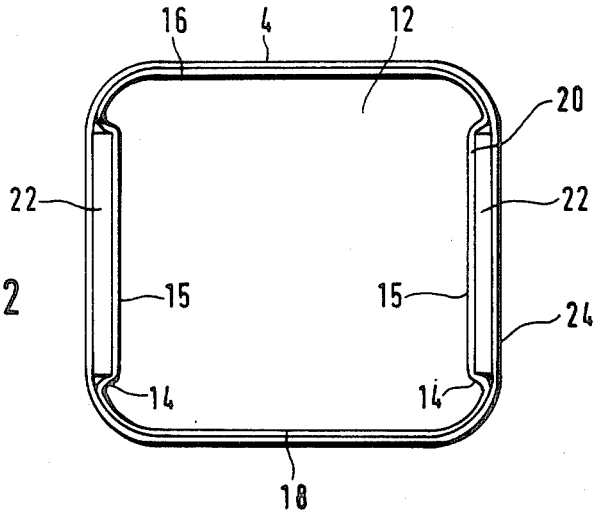
FIG. 2 shows a section along the line II—II in FIG. 1 through a boom spar.

As shown in FIG. 2, the spars each have a profiled core 12 made from a rigid foam. The use of polystyrene foam is preferably, since this only absorbs moisture to a negligible extent.

The foam material core 12 is provided on two opposite sides, which correspond to the inside and the outside of the spars, with plane surfaces 15, which here form the bases of grooves 14. The surfaces 15 run more or less parallel to one another and to the bending axis X of the boom spar. The two remaining side faces 16, 18, which lie on the upper side and lower side respectively of the boom and are adjacent to the plane surfaces, can be plane in design, but can also be arched outwards. In the case of the cross-sectional form according to FIG. 2, the transition at the edges is achieved by means of fillet radii 17, just as the flat grooves 14 can be designed with fillet radii at their lateral edges 19 in cross section.

Figure 5:
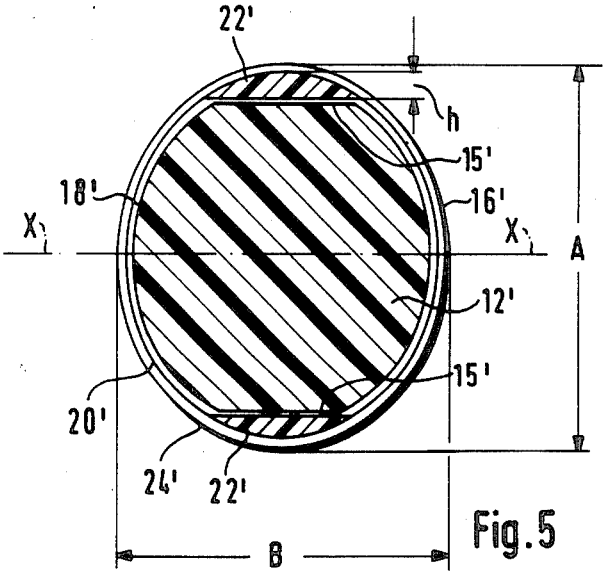
FIGS. 5 and 6 show in section along the line II—II in FIG. 1 two further embodiments of the cross section of the spars.
Figure 6:
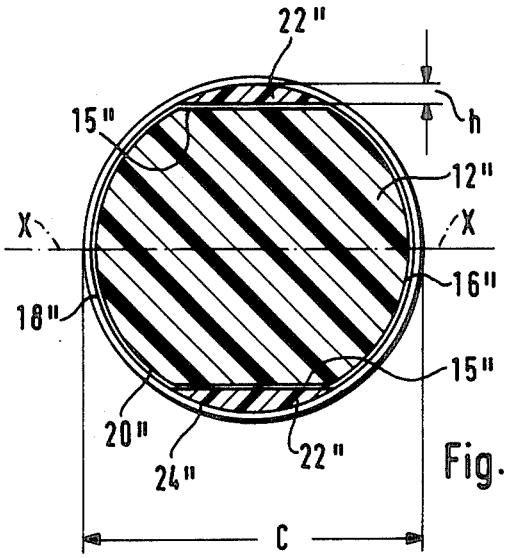

In the case of the embodiments according to FIGS. 5 and 6, the cross sections of the boom spars are either oval—FIG. 5—or round—FIG. 6. The plane surfaces 15′ and 15″ respectively here pass directly into the curved areas 16′, 18′ and 16″, 18″ respectively, as can be seen from FIG. 5 top left.

The rigid foam cores 12 are preferably shaped from a cold-pressed moulding, which might for example be cut out of a sheet, either by milling or grinding. The core does not need to extend across the entire length of the spar in a single integral unit. Instead, shorter sections can be brought to the required length by means of endwise adhesion.

The profiled foam material core has on its upper surface an inner or first layer 20 of synthetic-resin bonded fibrous braiding with fibre strands intersecting at angles of between 30° and 60°, and preferably at an angle of around 45°, to the longitudinal extension of the spars. For preference, a conventional fabric tube with fibre strands intersecting on the core at around 45° is used here. But fabric strips can also be used, which are cut for example at 45° to warp and weft. Such strips are arranged about the foam material core in such a way that they overlap at their free longitudinal edges. This overlapping can occur for example in the area of one of the surfaces 16, 16′, 16″ or 18, 18′, 18″ of the core. Such a layer need not extend across the entire length in a single integral unit either. Instead, individual sections can be applied adjacent to each other. The inner layer 20 gives the boom torsional strength. The fibrous braiding of this layer is preferably composed of carbon fibres.

There are provided on the inner layer 20, 20′, 20″ in the area of the facing plane surfaces 15, 15′, 15″ unidirectional fibre strands 22, 22′, 22″, which extend in the longitudinal direction of the spar. Carbon fibres are used for the strands. It is advisable that the unidirectional strends be applied in the form of previously cured strips from synthetic-resin bonded unidirectional carbon fibres. Special clamping accessories for these strands, which would otherwise have been necessary while the synthetic resin was curing so as to keep these stretched and parallel to one another in order to avoid waves which might affect the strength, are thus rendered superfluous. The cured strips from unidirectional strands 22 can, as is shown in FIG. 2, be designed with a basically rectangular form in cross section. On their outside 23 they can however also be curved according to the cross sectional form of the boom spar, as in the case of the embodiments according to FIGS. 5 and 6. Here these strips 22' and 22'' respectively are designed in cross section as a segment with a height h.

An outer layer 24 from a synthetic-resin bonded fibrous braiding is then provided as a cover across the entire length of the spars. Here it is preferably that a braiding tube be used, which at application can be stretched evenly and uniformly without difficulty, which results in a uniform surface and which simultaneously keeps the inner layer 20 and the unidirectional strands 22 in contact with each other and the core during the impregnation with synthetic-resin and during the curing of the synthetic-resin under prestressing.

The outer layer 24 should be composed of polyester- or polyamide fibres, which provide the boom with good handling properties when it is being used. A thin foam coating can be provided for kindness to skin and so that a high slip-resistance might be achieved. In case the material of the outer layer should be UV-sensitive, as is the case with aramide fibres, an opague pigmented coating should be provided. Glass fibre fabric can also be used for the outer layer.

The spar sections, as have been described above with reference to FIG. 2, can be laid down on working surfaces curved according to the curvature of the boom spar after the inner layer 20 has been impregnated with resin and after loading of the previously cured strips of synthetic-resin bonded unidirection fibre strands 22. As a result of the essentially plane exterior surfaces of the section according to FIG. 2, which lie parallel to the bending axis X of the section, no special measures need to be adopted for mounting the section on the profile gauge. It is generally enough if there are provided at the ends of the spars means whereby they can be held in contact at the working surfaces. If necessary, longitudinal guides for the sections can be in the form of contact edges or the like, in particular for the cross sectional forms according to FIGS. 5 and 6. On the boom spars which are inherently stable after the curing of the resin, the outer layer 24 is mounted and is impregnated with synthetic resin. The spar can then be freely suspended for the curing of this synthetic-resin. The outer layer can also be applied "wet on wet", which means directly after the inner layer and the unidirectional strips are impregnated.

The spars are preferably produced with a certain excess length, so that they can then be adjusted to their final length by separating the end pieces. Provided that the boom needs to be collapsible, sleeves, if necessary with guide keys or guide slots, can be laminated in at the ends of the boom spars. To this end, appropriately prepared end pieces can for example be bonded bluntly against the ends of the rigid foam core. The sleeves can therefore be surrounded on the outside with rigid foam according to the section of the core of the spar, a profile modification also being possible in the end piece. For example, the very approximately quadratic cross section of the spar section according to FIG. 2 can change into a round or oval cross section at the ends of the spar. It is therefore advisable that the inner and outer layer as well as the unidirectional strands or strips 22 extend beyond the end of such an end piece and be cut off after curing.

Spar sections designed with sleeves at the ends in the way described can for example be combined with known high strength boom end pieces made from metal, and in particular aluminum. But is is also possible for boom end pieces to be used which are designed in a similar way to the spar sections. The spar sections can also be rigidly combined with the end pieces of the boom.

Figure 3:
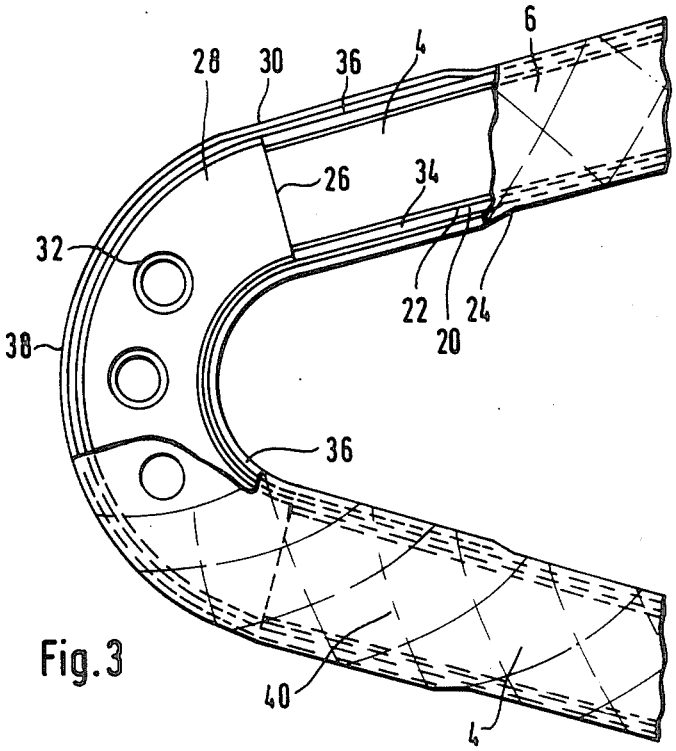
FIG. 3 shows a scaled-up top view of the design of the boom in the area of the front end piece of the boom, in partial horizontal section.

The front end of a single integral unit design boom is shown in FIG. 3. In the case of this embodiment, the spars 4, 6 terminate in an end face 26, to which the inner layer 20, the unidirectional strands 22 and the outer layer 24 extend, as can be seen from the upper half of FIG. 3, which shows a partial horizontal section. The boom end piece 28 is in this case a rigid foam shaped part, which in cross section can for example have the same profile as the two spars, which are connected by means of the boom end piece. Like the spars, the boom end piece is surrounded by an inner layer 30 from a synthetic-resin bonded fibre fabric or braiding, preferably from carbon fibres. In bore holes in the foam core there are arranged in the usual manner perpendicular rope end guide tubes 32 from a synthetic composite material, these being supported by the inner layer 30. A boom end piece 28 which is prepared in this way is bonded bluntly against the end faces 26 of the two boom spars 4 and 6. To avoid protrusions, the boom spars can be prepared for the fitting of the boom end pieces by the grinding of a slope 34 at the ends of the unidirectional strands 22. After the boom end pieces 28 are bonded to the spars, impregnated unidirectional strips 36 are then applied in several layers on the inside and the outside of the boom end pieces, these strips being layered according to the warping of the unidirectional strips of the spars and so allowing a direct fitting with the unidirectional strips of the spars. The unidirectional strips can be held in position after assembly by means of thread windings.

The outer layer 38 is then applied on the boom end pieces preassembled in this way. This outer layer can be a braided tube, which extends at least beyond the fitting of the unidirectional strips across the boom spars. It is also possible however to apply as an outer layer a binding wound around the ends of the spars and the boom end piece at an angle of between 30° and 60°, and preferably at an angle of around 45°. Such a binding 40 is shown in the lower half of FIG. 3. As is shown by the broken lines, it is also possible, if so required, for two bindings may be wound in opposite directions. In the area of the rope guiding tubes 32, appropriate openings are then provided in the outer layer after curing.

The rear boom end piece can be solidly connected with the spars in the same way as the front boom end piece.

Figure 4:
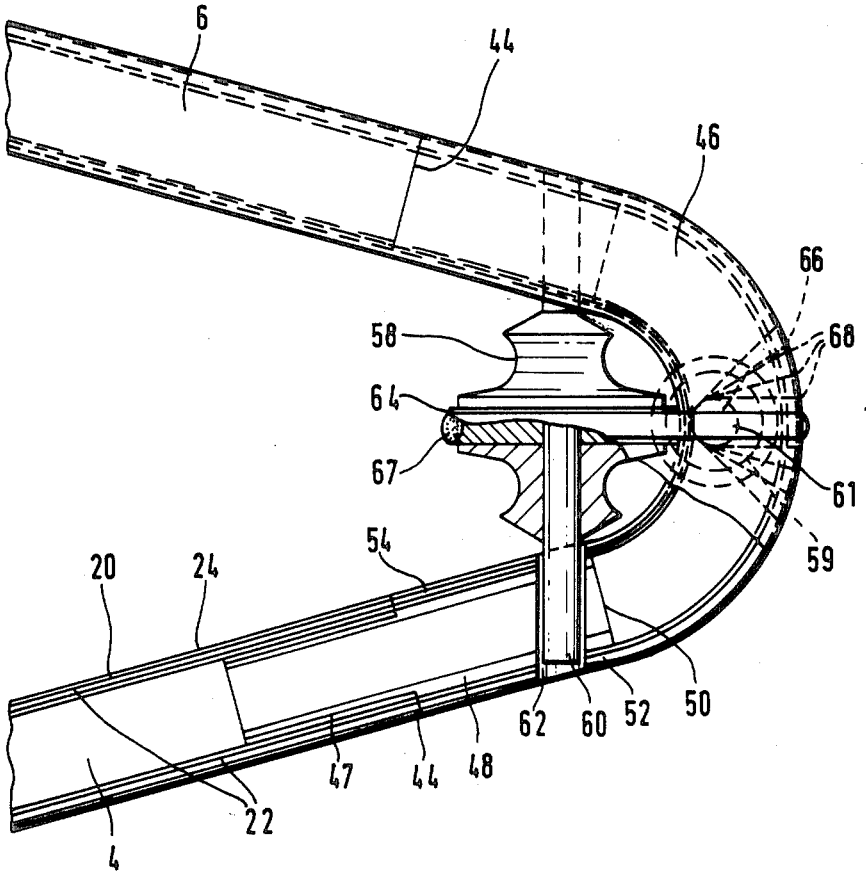
FIG. 4 shows a scaled-up top view of an embodiment of the rear end piece of the boom, in partial horizontal section in the lower half.

A detachable connection between the spars and the boom end pieces is shown in FIG. 4 in connection with a rear boom end piece 46. As has already been described above, there are in this case inserted into the ends of the boom spars 4, 6 sleeves 47, by means of which the inner layer 20, the unidirectional strands 22 and the outer layer 24 are guided to the face 44 at the end of the spars 4, 6. The rear boom end piece 46 which is shown here is once more a shaped part made from a rigid foam, where the section can again be designed according to FIGS. 2, 5 or 6. In the elbow ends of the boom end piece 46 there is mounted a coupling tube 48. This can for example be achieved by means of an inherently stable shaped part, into which the coupling tube 48 is inserted and which can for example be bluntly bonded at its end against the rigid foam shaped part, which in this case can for example terminate in the area of the inner end 50 of the coupling tube 48. The boom end piece 46 with the extensions holding the coupling tube 48 is again covered with an inner layer 20, preferably of carbon fibres. There are also provided unidirectional strips 52, 54 on the outside, and here in each case on the inside as well. On the outside there is again applied an outer layer 24, which can be a braided tube or a fabric tube, but which can again also be a binding.

In the case of the embodiment according to FIG. 4 there are shown two sail tension rollers 58 with horizontal axis, which are positioned on a pivot pin 60, which can be passed through tubes into bore holes 62, which are arranged in alignment with each other in the area of the elbows of the boom end pieces 46. These tubes can pass through the coupling tubes and so help to support them. In order that the trimming rope end might be guided better, the sail tension rollers are separated by the cross piece 64, which helps to support the steering pivot pin 60 through the bandage 67.

It is also possible to provide a guide tube 66 in the area of the foam material core, as is shown by the broken lines in FIG. 4 for receiving a sail tension roller pivot pin with its axis perpendicular axis to the plane of the boom. Such a guide tube 66 can be supported radially by means of a thread winding 68, which is wrapped around the ends of the guide tube 66 and is guided across the outer perimeter of the boom end piece above the unidirectional layer. It is advisable that such a thread winding 68 should be attached beneathe the outer layer 24. In the case of this arrangement of the sail tension rollers 59, these would be mounted on both outer ends of the pivot pin 61.

Guide tubes for fastening the steering pivot pins for the sail tension rollers can also of course be provided in the way described where the boom is designed in a single integral unit.

Booms according to the invention are characterised both by an outstanding rigidity and by a very low weight. A boom of length 2.3 m can for example be produced with a weight of around 1 kg where the design is that of a single integral unit.

According to the German Industrial Standard DIN 7879, a boom must achieve an ultimate load of 1000 N. High-performance booms from aluminium are dimensioned for an ultimate load of 2000 N. For a boom of length or span equal to 2 m, the maximum bending moment is therefore 600 Nm.

Booms according to FIGS. 5 and 6 were dimensioned in the following way so that the aforementioned values might be attained.

For a boom spar with an oval spar cross section according to FIG. 5, the exteral dimensions A=36 mm and B=30 mm were chosen. At the two ends with the smaller radius of curvature there are designed plane surfaces 15' which are parallel to one another. For the strips 22' of previously cured synthetic-resin bonded unidirectional carbon fibres to be applied on these surfaces, there was chosen a cross section in the form of a segment with a height h=3 mm. The resultant cross sectional area for the two strips 22' was therefore around 30 $mm^2$. The strips 22' were produced from a carbon fibre web of the type T 800 H 12000 40 B manufactured by the Torayka company of Japan. The webs were impregnated with epoxide resin with 60% volume resin and 40% volume curer and were cured in the cross sectional form specified.

On the core 12' of polystyrene foam with 35 $kg/m^3$ volumetric weight there was applied as an inner layer 20' a carbon fibre braided tube of the type KB 4008 /Sigri produced by the Sigri Elektrographit company of Meitingen, Federal Republic of Germany, and this was impregnated with epoxide resin in a mixture of 50% volume resin and 50% volume curer. On this fibre tube were applied the previously cured strips 22' and as an outer layer 24' there was applied a carbon fibre braided tube, for which the same type was used as for the inner layer 20'. This outer braided tube was impregnated with epoxide resin with 40% volume resin and 60% volume curer.

After the resin had cured, the boom spar designed straight for measurement purposes had a flexural stiffness of $119\times10^7$ N $mm^2$ and a maximum bending moment $M_{Bmax}$ of 600 Nm about the bending axis X—X. The spar weight was equal to 194 g per meter.

In the case of a boom spar with a round cross section according to FIG. 6, an outer diameter C of 33 mm was chosen. For the strips 22'' of unidirectional carbon fibres there was chosen as a cross section a segment with a height of 4.3 mm, which corresponds to a cross sectional area of around 50 $mm^2$. For the two braided tubes and the two strips 22', the same types were used as in the case of the boom spar according to FIG. 5. The same method of preparation and application was used as in the case of the production of the boom according to FIG. 5. The same flexural stiffness of $119\times10^7$ and a maximum bending moment $M_{Bmax}=600$ Nm about the bending axis X—X were achieved. The spar weight was equal to 254 g per meter.

I claim:

1. In a wishbone-type boom for a sail board comprising a pair of elongated, arcuately outwardly bowed spars joined at opposite ends thereof with end pieces and adapted for receiving a sail therebetween, the improvement comprising each of said spars comprising an elongated substantially rigid foam core having elongated, substantially flat, longitudinally extending inner and outer sides which face inwardly toward said sail and outwardly away from said sail, respectively, when the latter is received between said spars, a first reinforcing layer of resin-bonded, synthetic fibrous material over said core, the fibers of said first reinforcing layer crossing each other at angles of between 30° and 60° with respect to the longitudinal extent of said core, a pair of elongated, longitudinally extending inner and outer stiffening members on said reinforcing layer, said inner and outer stiffening members being formed from substantially unidirectional, longitudinally disposed, resin-bonded carbon fibers and having substantially flat longitudinally extending surfaces thereon which face the inner and outer surfaces of said core, respectively, and a second reinforcing layer of resin-bonded, synthetic fibrous material over said first reinforcing layer and said stiffening members, the fibers of said second reinforcing layer crossing each other at angles of between 30° and 60° with respect to the longitudinal extent of said core.

2. In the boom of claim 1, said cores each having elongated longitudinally extending grooves therein which define said substantially flat inner and outer sides thereof, said stiffening members being at least partially disposed in said grooves.

3. In the boom of claim 1, said second layer comprising fibers selected from the group consisting of polyester fibers and polyamide fibers.

4. In the boom of claim 1, said foam core comprising polystyrene foam.

5. The boom of claim 1 further comprising sleeves connecting said spars to said end pieces.

6. In the boom of claim 1, said end pieces each comprising a rigid foam end piece core having opposite ends and having an end piece groove therein including an elongated substantially flat groove surface which faces outwardly and away from said sail when the latter is received between said spars, an inner layer of synthetic resin bonded fiber fabric over said end piece core thereof, a preformed end piece stiffening element in said end piece groove thereof, said end piece stiffening element thereof comprising synthetic resin bonded unidirectional carbon fibers and extending beyond the ends of said end piece core thereof and a distance along the outer side of each of the adjacent portions of said spars and an outer layer of synthetic resin bonded fabric over said inner layer of resin bonded fabric thereof and said end piece stiffening element thereof.

7. In the boom of claim 6, each of said outer layers comprising a fabric tube.

8. In the boom of claim 6, each of said outer layers comprising a woven binding wound at angles of between 30° and 60°.

9. In the boom of claim 8, each of said outer layers comprising two woven bindings wound in opposite directions.

10. In the boom of claim 6, said end pieces further characterized as front and rear end pieces, said front end piece further comprising rope guiding tubes laminated therein and extending in substantially perpendicular relation to the plane of said boom.

11. In the boom of claim 6, said end pieces further characterized as front and rear end pieces, said rear end piece further comprising a tube laminated therein and extending in substantially parallel relation to the plane of said boom for receiving a tension roller pivot pin.

12. In the boom of claim 6, said end pieces further characterized as front and rear end pieces, said rear end piece further comprising a guide tube laminated therein and extending substantially along the longitudinal axis of symmetry of said boom for receiving a tension roller pivot pin therein.

13. In the boom of claim 12, said guide tube being radially supported by a threaded winding.

* * * * *